US005964430A

United States Patent [19]

Coffey

[11] Patent Number: 5,964,430

[45] Date of Patent: Oct. 12, 1999

[54] WINDING ARBOR

[75] Inventor: James B. Coffey, Vandalia, Ohio

[73] Assignee: NCR Corporation, Dayton, Ohio

[21] Appl. No.: 09/086,199

[22] Filed: May 28, 1998

[51] Int. Cl.[6] ..... B65H 75/24

[52] U.S. Cl. ..... 242/571.1

[58] Field of Search ..... 242/571.1, 571.2, 242/576.1; 279/2.05, 2.06, 2.07, 2.08

[56] References Cited

U.S. PATENT DOCUMENTS

| | | | |
|---|---|---|---|
| 2,378,024 | 6/1945 | MacChesney . | |
| 2,385,692 | 9/1945 | Corbin et al. . | |
| 2,575,631 | 11/1951 | Link . | |
| 2,694,848 | 11/1954 | Chaya . | |
| 3,048,345 | 8/1962 | Willard | 242/571.1 |
| 3,104,074 | 9/1963 | Karr | 242/571.1 |
| 3,127,124 | 3/1964 | Tidland et al. | 242/571.1 |
| 3,391,878 | 7/1968 | Naccara | 242/571.1 |
| 3,599,889 | 8/1971 | Pfieffer . | |
| 3,802,639 | 4/1974 | Dowd, Jr. . | |
| 3,856,226 | 12/1974 | Dowd, Jr. . | |
| 3,892,012 | 7/1975 | Keferstein . | |
| 3,908,924 | 9/1975 | Schulze . | |
| 3,942,735 | 3/1976 | Marchio et al. . | |
| 3,945,583 | 3/1976 | Ochs et al. | 242/571.1 |
| 3,995,747 | 12/1976 | Lewey et al. . | |
| 4,133,495 | 1/1979 | Dowd . | |
| 4,220,291 | 9/1980 | Papa . | |
| 4,327,877 | 5/1982 | Perini . | |
| 4,408,727 | 10/1983 | Dropczyniski . | |
| 4,473,195 | 9/1984 | Marin . | |
| 4,487,377 | 12/1984 | Perini . | |
| 4,572,451 | 2/1986 | Ikeda et al. . | |
| 4,611,638 | 9/1986 | Matumura . | |
| 5,452,496 | 9/1995 | Long et al. . | |
| 5,453,070 | 9/1995 | Moody . | |

FOREIGN PATENT DOCUMENTS

| | | |
|---|---|---|
| 2244190 | 3/1974 | Germany . |
| 3239661 | 5/1984 | Germany . |
| 37943 | 4/1981 | Japan . |
| 136745 | 10/1981 | Japan . |
| 623155 | 5/1949 | United Kingdom . |

OTHER PUBLICATIONS

Tidland Corp., "Slitting and Winding Equipment", Catalog No. AP–4–91, eight pages, year+ old.

Tidland Corp., "Series 800 and 850, Advanced Air Shaft Technology from Tidland", Catalog No. 800–5–95, four pages, 1994.

*Primary Examiner*—John M. Jillions

*Attorney, Agent, or Firm*—Francis L. Conte

[57] ABSTRACT

A winding arbor includes a tube having three circumferentially spaced apart rows of axially spaced apart slots extending radially therethrough. A plurality of jaws are disposed inside the tube, with each jaw including an arcuate base and a plurality of axially spaced apart integral lugs disposed in the slots. An elastic bladder is disposed inside the tube inboard of the jaw bases and is expandable to deploy the jaws radially outwardly for projecting the lugs through the slot.

4 Claims, 4 Drawing Sheets

WINDING ARBOR

BACKGROUND OF THE INVENTION

The present invention relates generally to winding sheet rolls, and, more specifically, to arbors therefor.

Sheet rolls are found in various sizes and forms for various equipment including adding machines, cash registers, Automated Teller Machines (ATMs), and various other forms of printers. Paper in a continuous sheet or ribbon is typically wound around a central tubular core of paper or plastic for example, to provide a paper roll for use in the printer. The wound sheet may be in other forms such as thermal transfer ribbons used in corresponding devices.

The ribbons, or continuous sheets, in the desired form are wound around the core in a corresponding winding machine specifically configured for operation at either low or very high winding speeds. In a typical production method, several cores are mounted coaxially on a common winding arbor or shaft typically in end-to-end contiguous arrangement, and the arbor is rotated for simultaneously winding respective ribbons on each of the adjoining cores. The leading edges of the ribbons may be wound around the cores either in a plain or tuckless configuration, or they may be tucked using a simple 180° fold.

In view of the manufacturing tolerances of the cores and ribbon width, and speed of winding, various problems may develop such as undesirable interleaving of adjoining ribbons, and protrusion of adjoining cores into adjacent wound rolls.

To reduce problems, it is important that the cores be accurately supported on the winding arbor and in the winding machine. A simple arbor in the form of a plain rod must necessarily have a smaller outer diameter than the inner diameter of the cores so that the cores may be readily assembled and disassembled from the arbor. The difference in diameter, however, permits slight misalignment between the adjoining cores and may degrade winding performance.

Another type of arbor known as an air expanding shaft has jaws which may be deployed radially outwardly through the walls of a surrounding tube by pressurizing an internal bladder. However, this type of arbor is made only in relatively large diameters and is not readily scalable downwardly in size to the small diameters required for typical thermal transfer ribbon and paper rolls wound on cores. For example, typical cores may be less than about one inch in inner diameter and down to about 0.375 inches which is extremely small, and renders impractical the downsizing of the large air expanding shaft for this purpose.

An additional problem in small core winding is that the associated arbor is exceptionally slender for mounting a suitable number of cores simultaneously thereon. For example, a winding arbor of about 30 inches in length and an outer diameter less than or equal to one inch is very slender. In order to maximize its bending stiffness, the arbor is typically solid. A hollow arbor would necessarily have an extremely thin wall which would substantially decrease the bending stiffness of the arbor.

Accordingly, it is desired to provide an improved expandable jaw winding arbor using a thin wall tube having an inner diameter less than or equal to one inch while maintaining adequate bending stiffness.

SUMMARY OF THE INVENTION

A winding arbor includes a tube having three circumferentially spaced apart rows of axially spaced apart slots extending radially therethrough. A plurality of jaws are disposed inside the tube, with each jaw including an arcuate base and a plurality of axially spaced apart integral lugs disposed in the slots. An elastic bladder is disposed inside the tube inboard of the jaw bases and is expandable to deploy the jaws radially outwardly for projecting the lugs through the slot.

BRIEF DESCRIPTION OF THE DRAWINGS

The invention, in accordance with preferred and exemplary embodiments, together with further objects and advantages thereof, is more particularly described in the following detailed description taken in conjunction with the accompanying drawings in which.

DESCRIPTION OF THE PREFERRED EMBODIMENTS

Figure 1:
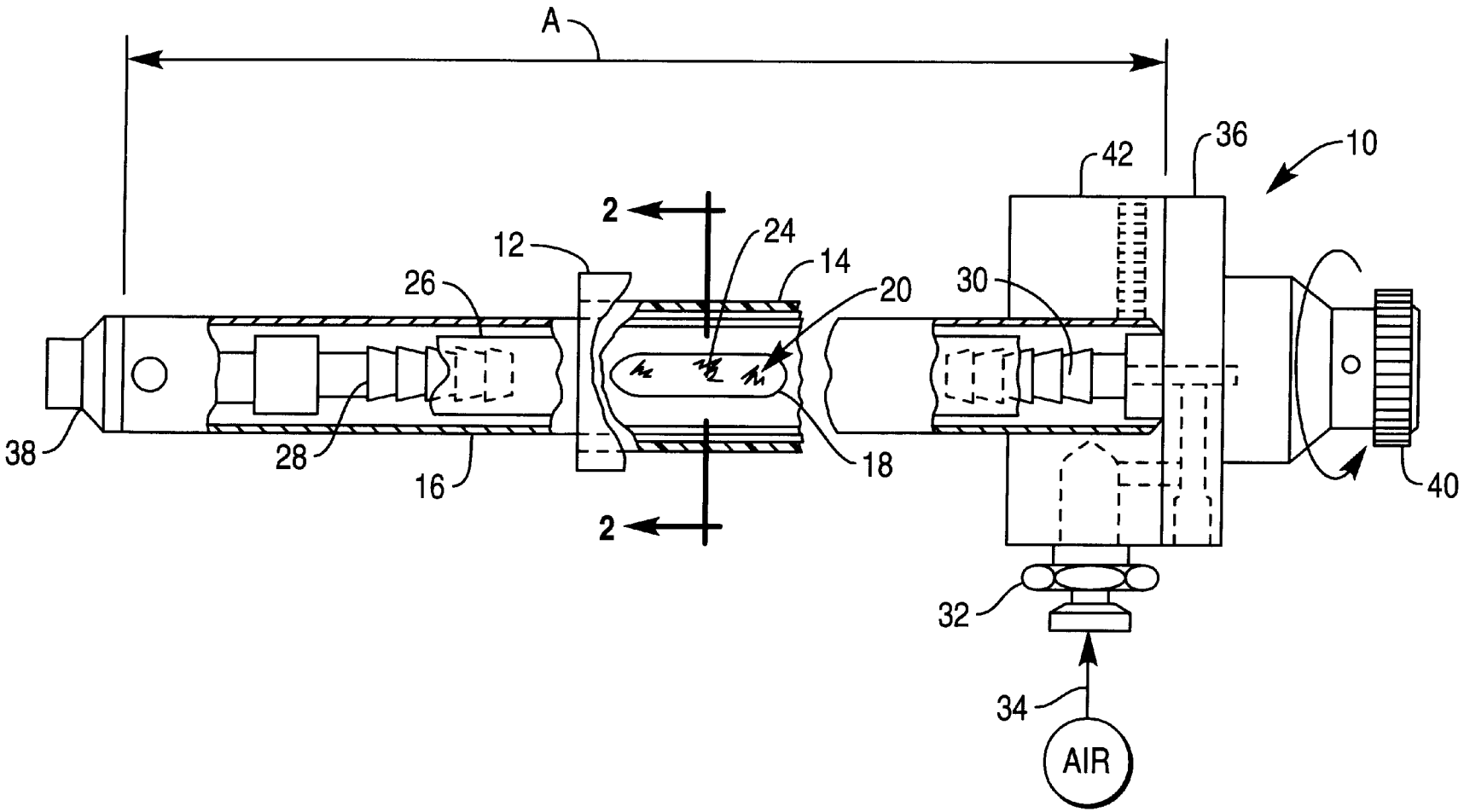
FIG. 1 is a partly sectional elevational view of a winding arbor in accordance with an exemplary embodiment of the present invention.

Illustrated in FIG. 1 is a winding shaft or arbor 10 in accordance with an exemplary embodiment of the present invention for use in a conventional winding machine (not shown) for winding continuous sheets or ribbons 12 on a tubular core 14. In a typical winding machine, several cores 14, about thirty for example, are mounted coaxially and end-to-end around the arbor 10 so that corresponding ribbons 12 may be simultaneously wound thereon as the arbor 10 is rotated in the machine. The ribbons 12 may be paper, plastic, or thermal transfer material, and the cores may be paper or plastic for example.

Since it is desirable to wind very small diameter cores 14, the arbor 10 is specifically configured in accordance with the present invention for use therewith. More specifically, the arbor 10 includes an elongate or slender cylindrical body or tube 16. The tube 16 is additionally illustrated in FIG. 2 in section and has a relatively thin cylindrical wall with suitable diameter for being mounted inside the small cores 14. The tube has an axial length A along its longitudinal centerline axis, an inner diameter B, and a wall thickness C.

In an exemplary embodiment, the tube 16 is made of steel with a 40 mil wall thickness C and an inner diameter B less than or equal to one inch and down to about 0.375 inches, with a length A of about 32 inches. The length to inner diameter aspect ratio is relatively high, and is about 85 in this example. The tube 16 therefore has a limited bending stiffness in view of its high aspect ratio and thin walls.

Figure 3:
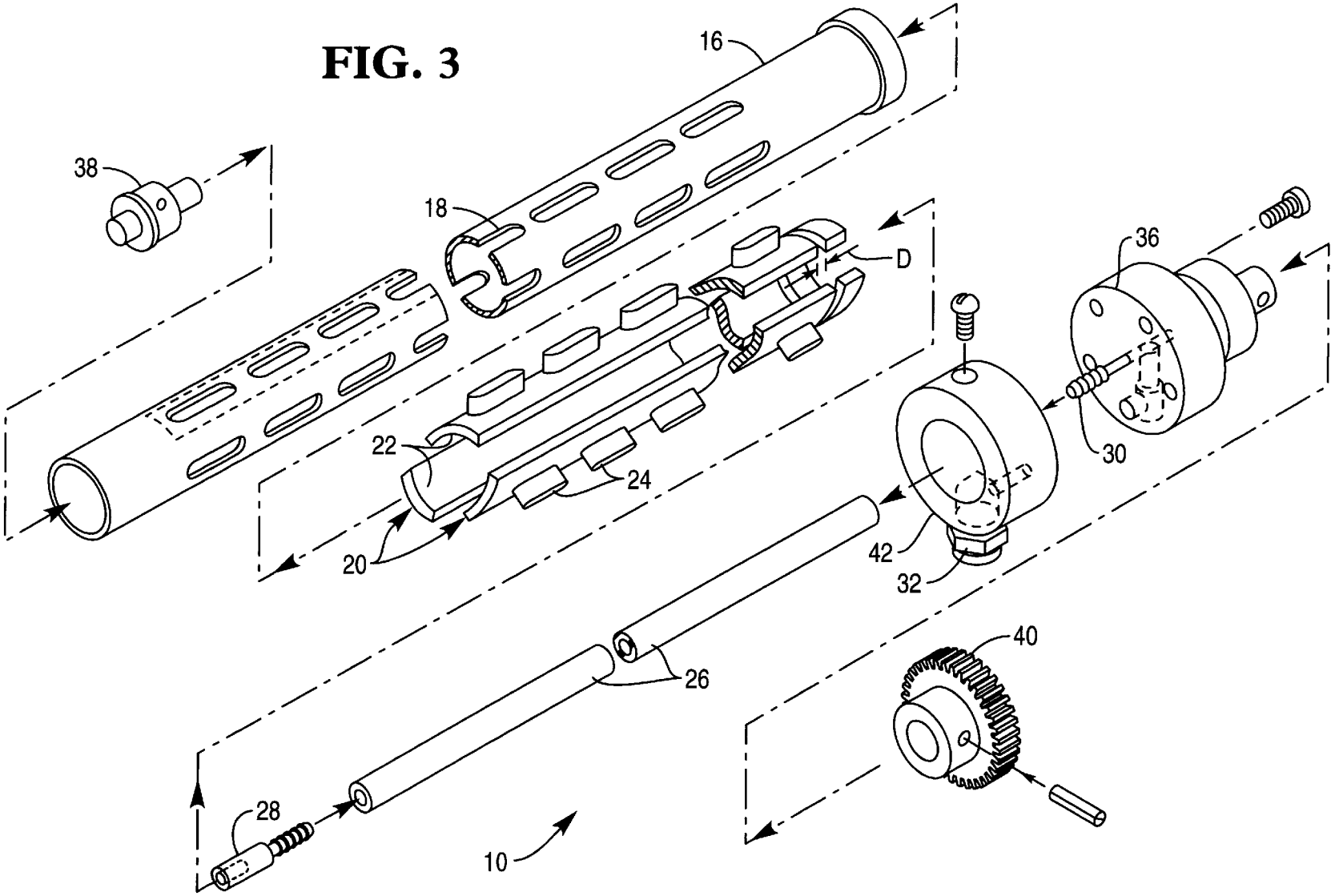
FIG. 3 is an exploded isometric view of the winding arbor illustrated in FIG. 1 showing in more detail certain components thereof for being assembled together.

As shown in more particularity in FIG. 3, the tube 16 preferably includes three circumferentially spaced apart rows of axially spaced apart slots 18 extending radially through the wall thereof. In this exemplary embodiment, the slots 18 are oval with straight axially extending sides terminating in an opposite pair of semicircular ends.

A plurality of jaws 20 are disposed inside the tube 16 in three corresponding rows. Each jaw 20 is in the form of an axially elongate strip preferably made of brass and includes an arcuate common base 22 and a plurality of axially spaced apart integral tabs or lugs 24 disposed in respective ones of the slots 18. Each lug 24 is complementary in configuration with its corresponding slot 18 and is also oval with straight axially extending sides terminating in semicircular ends.

An elastic bladder 26 in the form of a rubber or latex tube is disposed inside the arbor tube 16 radially inwardly or inboard of the jaw bases 22.

Means as described in more detail hereinbelow are provided for selectively expanding the bladder 26 to drive or deploy the jaws radially outwardly for projecting or extending the lugs 24 through the slots 18 for contacting the inner surface of the cores 14 being retained thereon. Retraction of the jaws 20 terminates the engaging force with the cores 14 allowing them to be readily removed from the arbor and replaced with subsequent empty cores.

Figure 2:
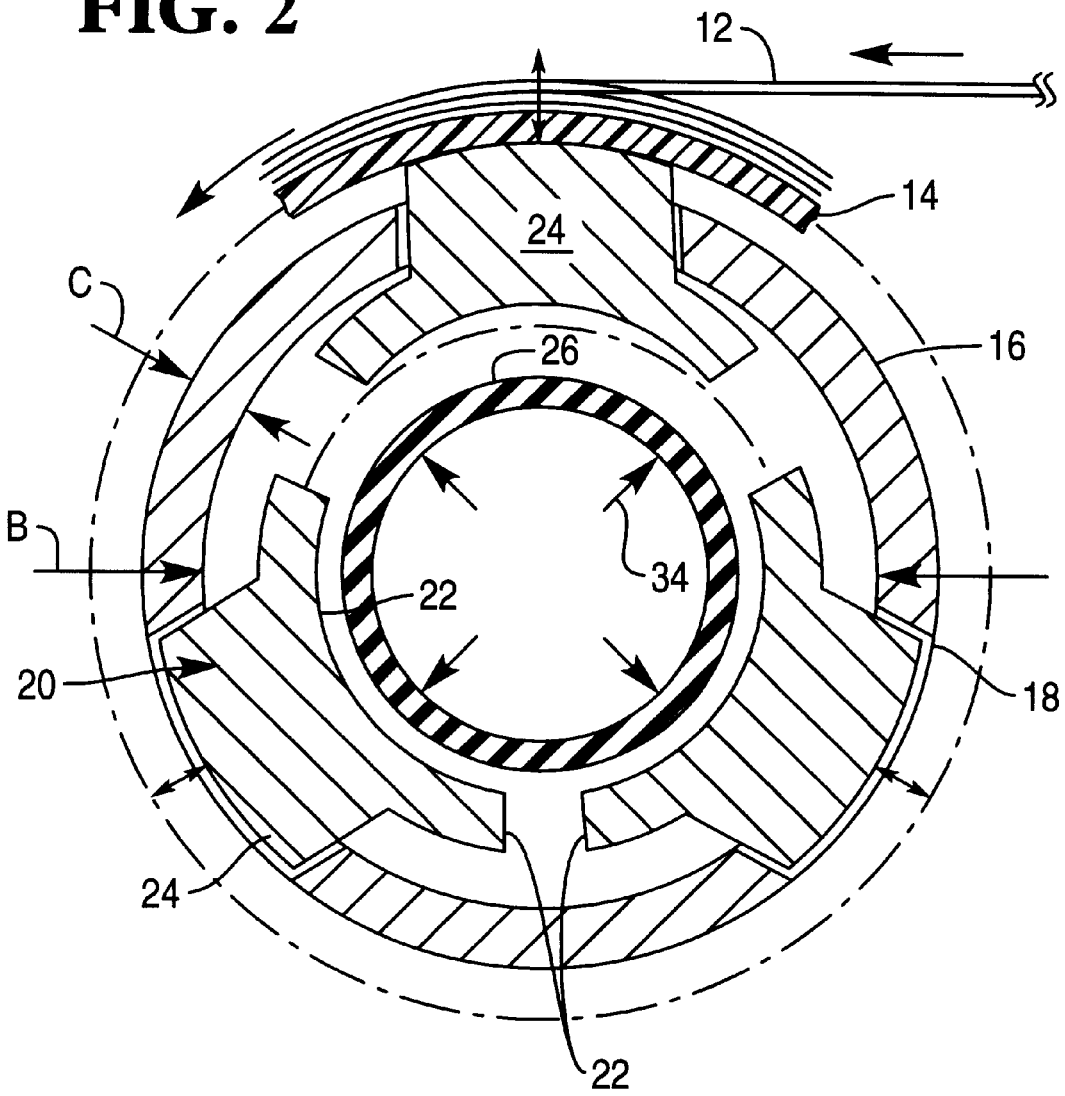
FIG. 2 is a radial sectional view through the winding arbor illustrated in FIG. 1 and taken general along line 2—2.

As shown in FIG. 2, the rows of slots 18 and corresponding jaws 20 are preferably equiangularly spaced apart at 120° for uniformly distributing the engagement force on the cores 14 for promoting self-centering thereof. As shown in FIG. 3, each of the rows of slots 18 is preferably colinear with the corresponding row of jaws 24 along the longitudinal axis of the tube 16, and the elongate lugs 24 are correspondingly colinearly aligned with each other in each row.

Since each jaw base 22 integrally supports a plurality of the aligned lugs 24, the jaw bases 22 internally bridge the corresponding slots 18 for structurally reinforcing the tube 16 when the jaws 20 are deployed under pressure. Since the jaw bases 22 and lugs 24 extend axially in the tube 16, they provide substantial additional bending stiffness or rigidity of the tube 16 when deployed under pressure in contact with the inner surface of the tube 16. The bases 22 bridge together adjacent axial slots 18. Although jaws 20 in each row of slots 18 may be configured as unitary members extending the full length of the tube 16 for maximizing stiffness, they are preferably formed in a few axial segments for improving ease of assembly of the small components.

Accordingly, each of the rows of slots 18 preferably includes a plurality of the jaws 20 axially adjoining each other end to end, with a small gap or end clearance D being located between adjacent axial slots 18. The clearance D is preferably as small as practical and may be several mils for example. In the exemplary embodiment illustrated in FIG. 3, each row of slots 18 includes three jaws in axial alignment with only two end clearances D therebetween. The individual jaws 20 still provide substantial stiffening of the tube 16 when deployed over their individual length, as well as from jaw-to-jaw in view of the small clearance D between the contiguous jaws and their location axially between adjacent slots 18 in solid portions of the tube 16.

An exemplary embodiment of the bladder expanding means is disclosed in FIGS. 1 and 3 and includes a plug 28 in the form of a solid barb which is inserted in one end of the bladder 26 in fixed engagement therewith for sealing the bladder 26 at one end. A nipple 30 in the form of a tubular barb is inserted in the opposite end of the bladder 26 in fixed engagement therewith for providing a flow communicating path thereto.

A valve 32 in the exemplary form of a conventional two-way poppet valve is suitably disposed in flow communication with the nipple 30 for selectively channeling compressed gas such as air 34 to the bladder 26 for in turn expanding the bladder 26 inside the tube 16 for engaging and deploying the jaws 20 radially outwardly. In FIG. 2, the bladder 26 is illustrated in solid line in its contracted position with the bottom two jaws 20 also being retracted. A portion of the bladder 26 is illustrated in phantom line in its expanded position forcing radially outwardly the top jaw (as well as the bottom two jaws) in its deployed position, with the lugs 24 engaging the inner surface of the core 14.

The simple pressure force of the air inside the tube 26 expands the bladder 26 and transfers the force to the several jaws 20 which in turn clamp the individual cores 14 from the inside. The outer diameter of the tube 16 is slightly less than the inner diameter of the core 14 for allowing unrestrained assembly and disassembly of the core 14 axially over the tube 16 while permitting sufficient stroke of the jaws 20 for engaging the inner surfaces of the cores 14. The radial clearance may be several mils for example.

As shown in FIG. 3, the tube 16 is a simple cylindrical shaft open at its opposite axial ends. The bladder 26 and plug 28 preferably have a common outer diameter which is smaller than the inner diameter of the circumferentially arranged jaws 20 as shown in FIG. 2 so that the bladder 26 may be axially assembled through the tube 16 and pre-inserted jaws 20, as shown in FIG. 3, by inserting the plug end axially through one of the open ends of the tube 16.

During assembly of the arbor 10, the individual strip jaws 20 are axially inserted through one end of the tube 16 for dropping the lugs 24 thereof into their corresponding slots 18. Each row of jaws 20 may be thusly assembled into the tube 16 and suitably initially held therein. The bladder 26 is separately pre-assembled to the plug 28 and nipple 30, and this pre-assembly is inserted axially through the pre-assembled jaws 20.

Since the tube 16 has a very small inner diameter B, less than about one inch for example, the bladder 26 also has a correspondingly small outer diameter for minimizing its space requirements. And, the height of the lugs 24 and the circumferential width of the arcuate jaw bases 22 are selected to ensure that they may be assembled through the inside of the tube 16 as disclosed above, yet also provide sufficient height for the deployment stroke. The circumferential width of the jaw bases 22 is as large as practical for maximizing stiffness of the tube 16; and for maximizing support of the expandable bladder 26 and transferring the pressure forces therefrom; while also allowing internal assembly of the several jaws 20.

As shown in FIGS. 1 and 2, the nipple 30 is preferably integrally joined in a unitary member to an right endcap 36 which axially adjoins one open end of the tube 16 when assembled. A left endcap 38 is suitably configured to engage a counterbore in an end of the plug 28 as well as engage the inner surface of the opposite open end of the tube 16 in a generally externally flush joint, and is fixedly joined to the tube using a suitable pin fastener extending radially therein. The left endcap 38 provides an additional retention means for the plug 28 attached to the bladder 26, and also provides a support location for mounting this end of the arbor in a suitable bearing in the corresponding ribbon winding machine.

To further specifically configure the arbor 10 for use in the ribbon winding machine, the arbor further includes an involute spline 40 suitably fixedly joined to the right endcap 36 using a radial shear pin for example. The right endcap 36 is therefore specifically configured to include an aft extending boss which engages a complementary counterbore in the forward end of the spline 40 for providing a snug fit, radially through which the shear pin is mounted. The right endcap 36 is suitably fixedly joined to the arbor tube 16 so that torque on the spline 40 rotates the arbor 10 including all of its components during operation.

In the preferred embodiment illustrated in FIGS. 1 and 3, a specifically configured air receiver or collar 42 surrounds one end of the tube 16 and is fixedly joined thereto using a radial set screw for example. The right endcap 36 may be fixedly joined coaxially to the collar 42 using a plurality of axially extending screws as shown.

In this way, the bladder 26 may be pre-assembled to the plug 28, nipple 30, which is integral with the right endcap 36, with the collar 42 also being attached to the endcap 36. After the jaws 20 are assembled inside the tube 16, the entire pre-assembly of the bladder 26 may be inserted axially through a corresponding end of the tube 16 until the collar 42 surrounds the tube end. The set screw may then be installed for clamping the collar 42 to the tube 16. In this way, applied torque to the spline 40 is carried through the shear pin into the right endcap 36 and in turn through the collar 42 and into the tube 16 for rotating the entire arbor.

In this arrangement, the valve 32 is preferably attached perpendicularly or radially to the collar 42 and suitably disposed in flow communication with the nipple 30. This may be readily accomplished by drilling suitable passages radially into the collar 42 and then axially to its intersection with the endcap 36, with the axial passage engaging a radial passage therein which continues to the center of the right endcap 36 where it meets an axial passage which joins with the hollow nipple 30. Suitable gaskets or o-rings, or other seals may be used at the various joints in the passageway from the valve 42 to the nipple 30 for ensuring an air-tight passageway.

In this way, the compressed air 34 may be delivered through the valve 32 to the nipple 30 for pressurizing and expanding the internal bladder 26 for deploying all the jaws 20 simultaneously. The pressurized air within the bladder 26 may be simply released by releasing the valve 32 for expelling the air from the bladder and thusly allowing the jaws 20 to simultaneously retract for allowing replacement of the cores 14 on the arbor.

Various components of the arbor 10 illustrated in FIG. 1 may be made of a suitable material like steel, with the jaws 20 being preferably formed of brass to reduce oxidation and corrosion thereof.

Figure 4:
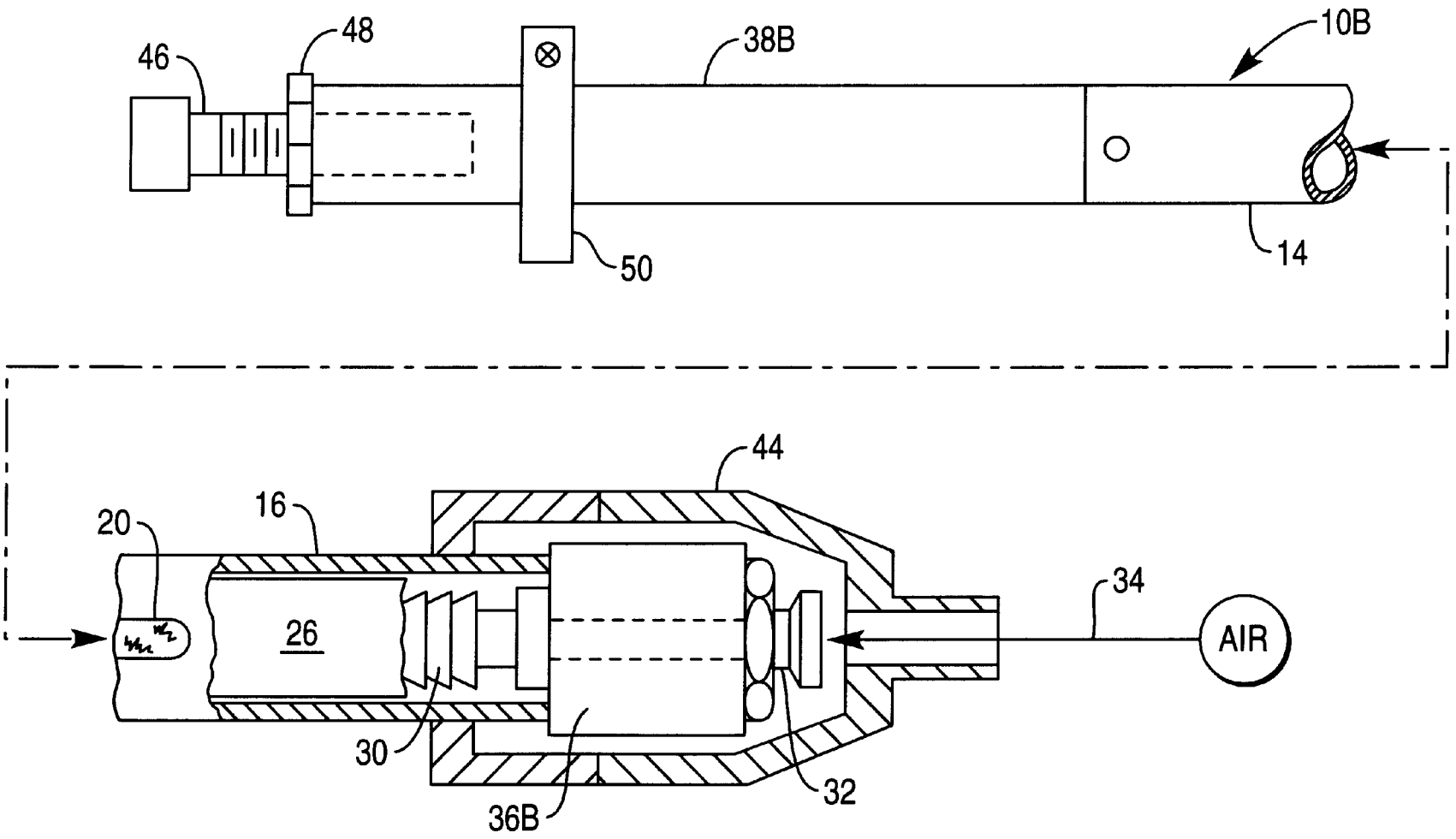
FIG. 4 is a partly sectional view of a winding arbor in accordance with another embodiment of the present invention.

Whereas the arbor 10 illustrated in FIGS. 1–3 is specifically configured for use in a conventional ribbon winding machine, FIG. 4 illustrates a modification of the arbor designated 10B which is substantially identical to the first embodiment except for components at its two opposite ends for use in a conventional slitting and winding machine (not shown) configured to produce tuckless paper rolls with cores, or for also producing coreless paper rolls without cores. In such a machine, the arbor 10B is mounted parallel to a pair of driving rollers which cradle the arbor and the cores or paper rolls being wound thereon, with a third idler roller thereatop. In this embodiment, the valve 32 is coaxially joined to the right endcap designated 36B specifically configured therefor.

A tubular housing or cover 44 surrounds the right endcap 36B and is fixedly joined to the open end of the tube 16 using a suitable set screw for example. The housing 44 may be formed of two or more portions for improving assembly thereof around the right endcap 36B, and also includes a coaxial access tube at one end through which compressed air may be provided to the internal valve 32. The housing 44 also acts as an end stop for the arbor shaft assembly as well as a protective cover for the air valve 32 to prevent accidental release of the compressed air during the winding cycle and in the automatic ejection cycle of the slitter winding machine.

In this embodiment, the left endcap, designated 38B, is in the form of an elongate extension which is joined to the plug 28 and open end of the tube 16 in the same manner as illustrated in FIGS. 1 and 3.

A threaded rod 46 threadingly engages the outboard end of the left endcap 38B for providing an adjustable fit to locate the arbor assembly between arbor guides of the slitter winder machine. A lock nut 48 is used to lock the rod 46 at a suitable extension from the left endcap 38B.

A stop ring or collar 50 surrounds the left endcap 38B and is adjustable in position along the length of the endcap and may be locked at any axial position by tightening a corresponding fastener therein. The stop collar 50 is used to trap or axially retain the many cores mounted over the tube 14 against the housing 44 for obtaining proper alignment in the slitter winding machine. The FIG. 4 embodiment of the arbor has a narrower profile than the first embodiment, and is allowed to rotate without obstruction with the driving rollers or cradles.

Both arbors 10, 10B disclosed above may be made in extremely small diameter sizes for use in supporting small diameter cores, or for winding paper without cores. When the jaws 20 are expanded inside cores 14, they rigidly stiffen the tube 16 and retain the individual cores thereon, and position and provide concentric alignment between axially adjacent cores. If no cores are used, the ribbon or paper would be wound on the outside diameter of the arbor body or tube while the jaws 20 are in their deployed position. After coreless paper rolls have been completely wound, the air pressure is released from the bladder 26 by actuating the valve 32 causing the jaws 20 to collapse and provide additional clearance between the arbor and the inside diameter of the wound roll. The resulting coreless roll may be readily removed from the arbor without restraint.

While there have been described herein what are considered to be preferred and exemplary embodiments of the present invention, other modifications of the invention shall be apparent to those skilled in the art from the teachings herein, and it is, therefore, desired to be secured in the appended claims all such modifications as fall within the true spirit and scope of the invention.

Accordingly, what is desired to be secured by Letters Patent of the United States is the invention as defined and differentiated in the following claims:

1. A winding arbor comprising:

a tube having three circumferentially spaced apart rows of axially spaced apart slots extending radially therethrough;

a plurality of jaws disposed inside said tube, each including an arcuate base and a plurality of axially spaced apart integral lugs disposed in said slots, wherein each of said slot rows is colinear with said jaws and includes a plurality of said jaws axially adjoining each other between adjacent slots and wherein said jaw bases bridge said slots for structurally reinforcing said tube when said jaws are deployed;

an elastic bladder disposed inside said tube inboard of said jaw bases;

means for selectively expanding said bladder to deploy said jaws radially outwardly for projecting said lugs through said slots, wherein said bladder expanding means further comprises a plug sealing said bladder at one end;

a nipple disposed in flow communication with said bladder at an opposite end, wherein said nipple is integrally joined to an endcap, and said endcap axially adjoins one end of said tube; and a valve disposed in flow communication with said nipple for selectively channeling compressed gas to said bladder and in turn expanding said bladder inside said tube for deploying said jaws;

a spline fixedly joined to said endcap, and said endcap is fixedly joined to said tube so that torque on said spline rotates said arbor;

a collar fixedly joined to said tube end;

said endcap being fixedly joined coaxially to said collar; and said valve is attached to said collar and disposed in flow communication with said nipple through said collar and endcap in turn.

2. An arbor according to claim 1 wherein said valve is coaxially joined to said endcap.

3. An arbor according to claim 2 further comprising a housing surrounding said endcap and fixedly joined to said tube end.

4. An arbor according to claim 3 further comprising an extension endcap fixedly joined to an opposite end of said tube at said plug.

* * * * *